US007890005B2

(12) United States Patent
Bradley et al.

(10) Patent No.: US 7,890,005 B2
(45) Date of Patent: Feb. 15, 2011

(54) ADJUSTING ELECTROSTATIC CHARGES USED IN A LASER PRINTER

(75) Inventors: Timothy Graham Bradley, Longmont, CO (US); Larry M. Ernst, Longmont, CO (US)

(73) Assignee: Infoprint Solutions Company, LLC, Boulder, CO (US)

( * ) Notice: Subject to any disclaimer, the term of this patent is extended or adjusted under 35 U.S.C. 154(b) by 123 days.

(21) Appl. No.: 12/350,202

(22) Filed: Jan. 7, 2009

(65) Prior Publication Data

US 2010/0172664 A1 Jul. 8, 2010

(51) Int. Cl.

| | |
|---|---|
| ***G03G 15/00*** | (2006.01) |
| ***G03G 15/02*** | (2006.01) |
| ***G03G 15/04*** | (2006.01) |
| ***G03G 15/08*** | (2006.01) |

(52) U.S. Cl. ..... 399/48; 399/49; 399/50; 399/51; 399/55

(58) Field of Classification Search ..... 399/48, 399/49, 50, 51, 53, 55; 358/406, 504, 296; 347/19

See application file for complete search history.

(56) References Cited

U.S. PATENT DOCUMENTS

| | | | |
|---|---|---|---|
| 4,179,213 | A | 12/1979 | Queener |
| 4,183,657 | A | 1/1980 | Ernst et al. |
| 4,377,338 | A | 3/1983 | Ernst |
| 4,625,176 | A | 11/1986 | Champion et al. |
| 4,829,336 | A | 5/1989 | Champion et al. |
| 4,879,577 | A | 11/1989 | Mabrouk et al. |
| 4,951,088 | A | 8/1990 | Bonvallet et al. |
| 5,128,698 | A | 7/1992 | Crawford et al. |
| 5,150,155 | A | 9/1992 | Rushing |
| 5,402,214 | A | 3/1995 | Henderson |
| 5,767,888 | A | 6/1998 | Schleusener et al. |
| 5,959,650 | A | 9/1999 | Fukui et al. |
| 6,021,285 | A | 2/2000 | Mestha et al. |
| 6,175,375 | B1 | 1/2001 | Able et al. |
| 6,177,948 | B1 | 1/2001 | Estabrooks et al. |
| 6,223,006 | B1 | 4/2001 | Scheuer et al. |
| 6,268,932 | B1 | 7/2001 | Lee et al. |
| 6,337,958 | B1 | 1/2002 | Stanich et al. |

(Continued)

FOREIGN PATENT DOCUMENTS

| | | | |
|---|---|---|---|
| JP | 09-236952 | A * | 9/1997 |

(Continued)

*Primary Examiner*—Sophia S Chen
(74) *Attorney, Agent, or Firm*—Duft Bornsen & Fishman, LLP

(57) ABSTRACT

A method, system, and manufacture for adjusting electrostatic charges in a laser printer. A charge is applied to a photoconductor drum surface to create a dark voltage. An image area of the photoconductor drum is exposed with a printhead using a defined energy level to discharge the charge from the image area. An exposure voltage of the photoconductor drum is measured after the image area has been exposed. A first optimization is performed to determine an adjusted dark voltage and an adjusted energy level based on the measured exposure voltage and the dark voltage and the energy levels applied to the photoconductor drum. An applicator voltage is applied to an applicator that applies toner to the exposed image area of the photoconductor drum. Toner density applied to the photoconductor drum is measured and a second optimization is performed to adjust the applicator voltage to produce a target toner density.

17 Claims, 4 Drawing Sheets

U.S. PATENT DOCUMENTS

| | | | | |
|---|---|---|---|---|
| 6,456,804 | B2 | 9/2002 | Izawa et al. | |
| 6,498,909 | B1 | 12/2002 | Reihl | |
| 6,507,714 | B1 | 1/2003 | Maess et al. | |
| 6,687,470 | B2 | 2/2004 | Shim et al. | |
| 6,771,912 | B1 | 8/2004 | Mo et al. | |
| 2006/0269306 | A1 * | 11/2006 | Shimizu | 399/49 X |
| 2007/0286622 | A1 * | 12/2007 | Morikuni | 399/49 |
| 2008/0112717 | A1 * | 5/2008 | Zaitsu et al. | 399/48 |

FOREIGN PATENT DOCUMENTS

| | | | |
|---|---|---|---|
| JP | 2007-279170 | A * | 10/2007 |

* cited by examiner

| Photoconductor Voltage | Toner Charge | Electro Photographic (EP) Laser Printer |
|---|---|---|
| Negative | Negative | Discharge area development |
| Negative | Positive | Charge area development |
| Positive | Positive | Discharge area development |
| Positive | Negative | Charge area development |

FIG. 4

ADJUSTING ELECTROSTATIC CHARGES USED IN A LASER PRINTER

BACKGROUND OF THE INVENTION

1. Field of the Invention

The present invention relates to a method, system, and article of manufacture for adjusting electrostatic charges used in a laser printer.

2. Description of the Related Art

In a laser printer, a laser beam projects an image of the page to be printed onto an electrically charged rotating drum. Photoconductivity removes charge from the areas exposed to light. Dry ink (toner) particles are then electrostatically picked up by the drum's charged areas. The image is electrostatically transferred to the paper and fused with heat and direct contact.

The electrostatic parameters of a laser printer comprises the voltage relationships that exist between the voltage to which the photoconductor is initially charged, the voltage of the photoconductor in its various discharged areas, such as image areas, and/or the toner applicator. The electrostatic parameters may be set as a function of the photoconductor's saturation voltage. The photoconductor's saturation voltage is defined as the voltage to which the photoconductor is discharged by high intensity illumination, and beyond which the photoconductor is not appreciably discharged by increasing the illumination intensity.

There is a need in the art to provide improved techniques for determining the electrostatic charges used in the laser printer to charge the photoconductor drum and toner.

SUMMARY

Provided are a method, system, and article of manufacture for adjusting electrostatic charges used in a laser printer. A charge is applied to a surface of a photoconductor drum to create a dark voltage. An image area of the photoconductor drum is exposed with a printhead using a defined energy level to discharge the charge from the image area. An exposure voltage of the photoconductor drum is measured after the image area has been exposed by the printhead. A first optimization is performed to determine an adjusted dark voltage and an adjusted energy level based on the measured exposure voltage and the dark voltage and the energy levels applied to the photoconductor drum. An applicator voltage is applied to an applicator that applies toner to the exposed image area of the photoconductor drum. Toner density of the toner applied to the photoconductor drum is measured and a second optimization is performed to adjust the applicator voltage to produce a target toner density.

BRIEF DESCRIPTION OF THE DRAWINGS

FIG. 4 illustrates a table showing the different charges that may be used for the photoconductor voltage and toner charge.

DETAILED DESCRIPTION

Figure 1:
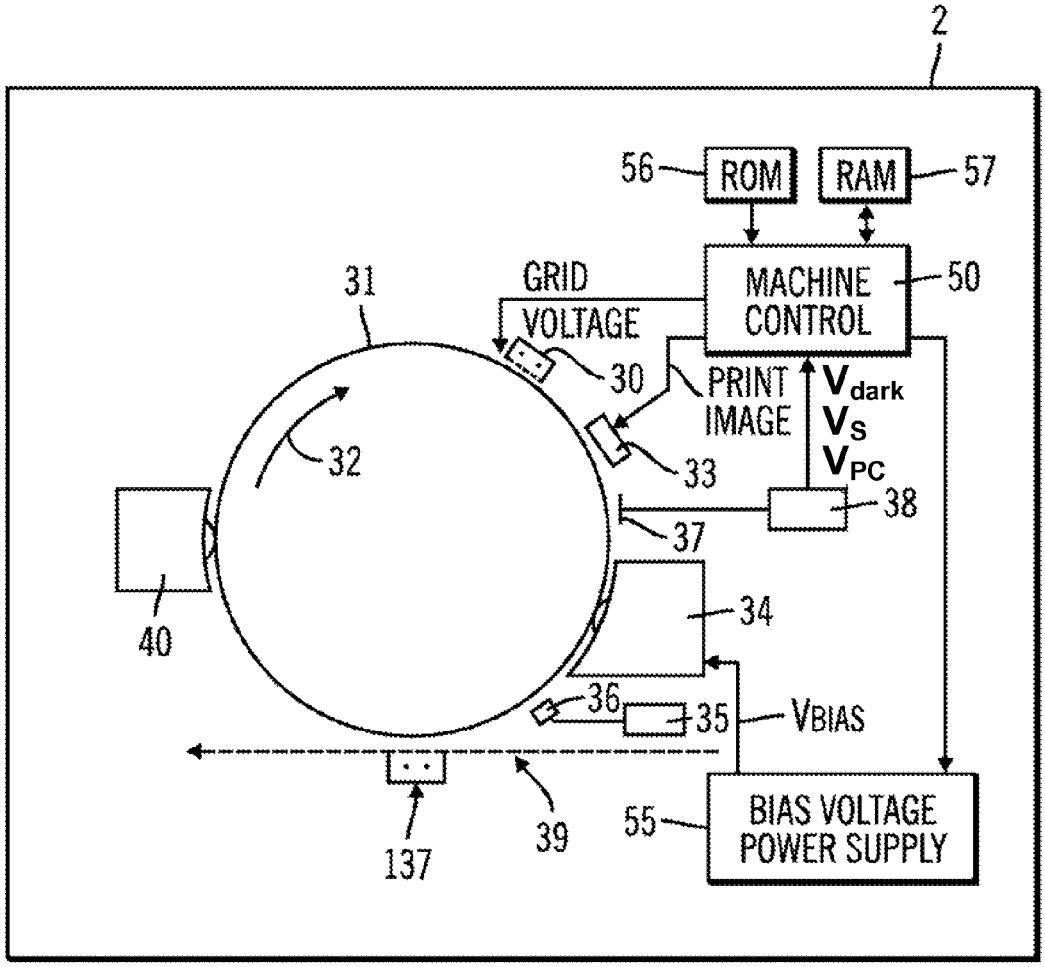
FIG. 1 illustrates an embodiment of laser printer components.

FIG. 1 illustrates an embodiment of a laser printer system 2 having a gridded charge corona 30 that is operable to charge drum shaped photoconductor 31, as this drum rotates at a substantially constant speed in the direction indicated by arrow 32. The corona 30 charges the drum with a dark voltage ($V_{dark}$), which is the discharge voltage to apply a negative charge to the photoconductor 31 to form the background or non-image area. The toner carries a negative charge and thus will not be deposited on those regions of the photoconductor 31 charged with the dark voltage. An imaging station comprising LED print head 33 operates, under control of the machine control 50, to discharge selected areas of the photoconductor 31 in accordance with the binary print image maintained in the RAM 57 or ROM 56 to form a discharged latent image on photoconductor drum 31. The multiple line image of the page being printed is contained in random access memory (RAM) memory 57 as many lines of multi-digit binary words. This portion of memory 57 comprises an electronic page image.

The print head 33 may be comprised of light emitting diodes (LEDs), which are selectively energized in accordance with the type of image being formed on the LEDs picture element (PEL) area of photoconductor 31. An LED control algorithm, contained in a read only memory (ROM) 56, may be used to determine if a given individual PEL area is associated with a small image area such as a text character, or if the PEL area is associated with a large image area.

An electrostatic probe (ESP) 38, having a sensing probe 37, is provided to measure or sense the voltage level of selected areas of the photoconductor drum 31. A toner applicator station 34 may comprise a magnetic brush developer 34 to apply toner to that portion of the photoconductor 31 surface having the latent image, or discharged by the print head 33. The applicator station 34 includes a development electrode voltage source 55.

The printer's photoconductor 31, which is initially charged to the dark voltage ($V_{dark}$), is discharged to lower voltages by increasing amounts of LED illumination intensity at the print head 33, which is referred to as the "energy level" applied by the print head 33 to discharge the dark voltage charge (Vdark) on the photoconductor drum 31. The magnitude of the photoconductor's initial charge voltage Vdark, is controlled, for example, by the voltage that is applied to the grid of charge corona 30 by machine control 50. The saturation voltage (Vs) is the maximum photoconductor discharge voltage. The Vbias is the voltage applied to the applicator 34 or mag brush to charge the toner, where the Vbias is charged by the power supply 55.

The printer 2 includes toner concentration controller 35 having a light reflection type patch sensor 36. This controller 35 controls the concentration of toner in the applicator station 34. The controller 35 may be controlled by the machine control 50. The major portion of the photoconductor's toned image is transferred to paper substrate at transfer station 137, as the paper moves along path 39. A cleaning station 40 operates to clean photoconductor 31 of residual toner, prior to reuse of the photoconductor in the reproduction process.

In the printer 2, the photoconductor's 31 background areas remain highly charged with the dark voltage, and toner is deposited only on the photoconductor's discharged latent image areas by the toner applicator 34.

In the printer 2, the image to be reproduced on paper is contained in a page memory such as RAM 57 as a binary electronic image. For example, the page memory includes a memory cell for each PEL. A binary "1" in a memory cell indicates that the corresponding PEL is to be colored by toner, and that the corresponding photoconductor PEL is to be discharged. This electronic image is gated to print head 33, to activate the print head's many LEDs in synchronism with movement of photoconductor 31 past the print head. Each individual LED of print head 33, when energized, illuminates a small photoconductor PEL, and discharges that PEL in accordance with the magnitude of the LEDs energization. In general, the higher an LED's energization, the more will the photoconductor's PEL be discharged.

In the described embodiments, the machine control 50 measures voltages using the sensors 37 and toner density at sensor 36 to adjust the dark voltage (Vdark) applied to the photoconductor surface 31 at corona 30, adjust the energy level which is the discharge voltage applied on the print head 33 to form the print area, and to adjust the voltage applied to the applicator 34 or mag brush.

Figure 2:
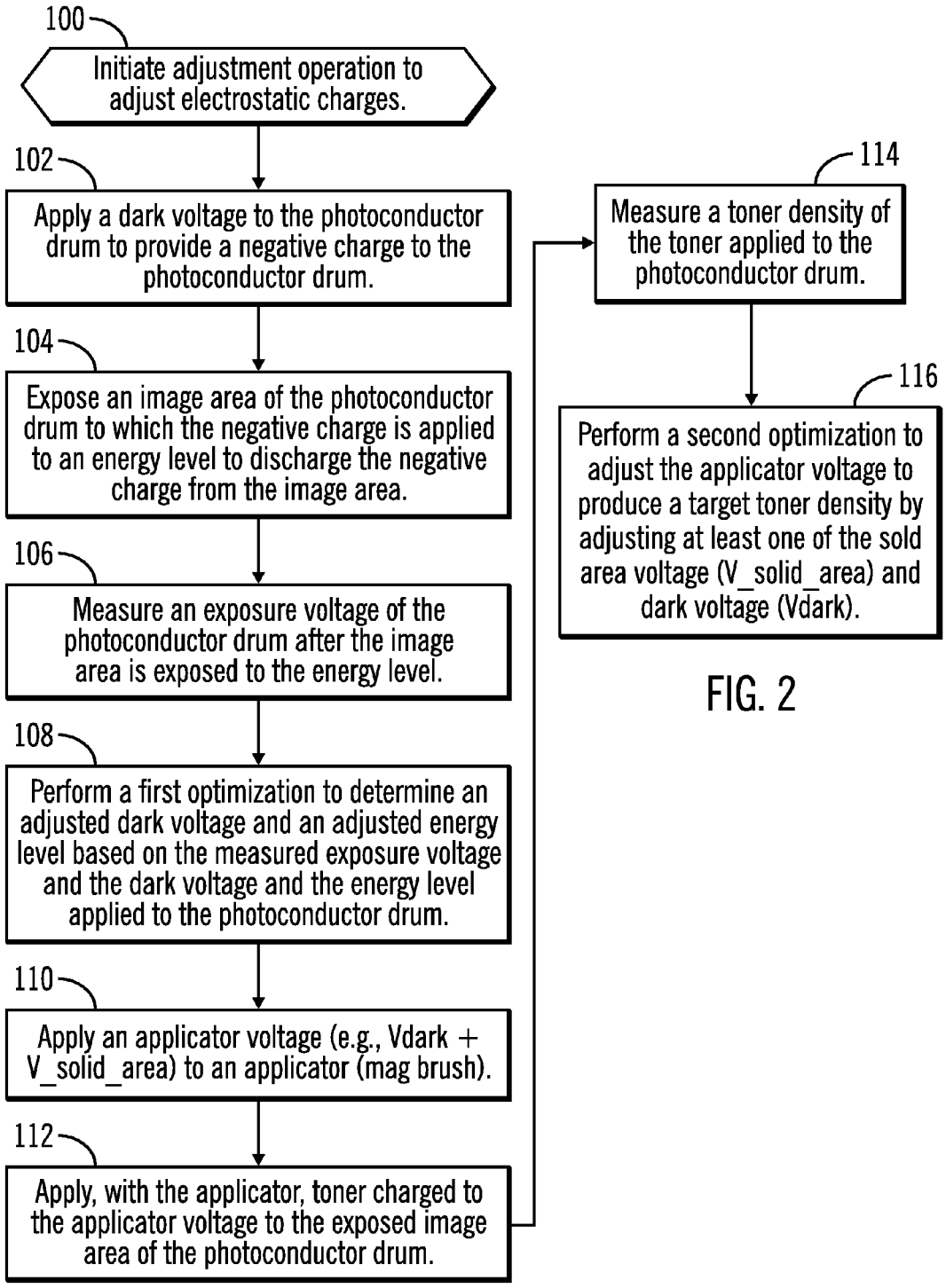
FIG. 2 illustrates an embodiment of operations performed to determine the electrostatic charges to use during print operations.

FIG. 2 illustrates an embodiment of operations performed by the machine control 50 to determine the dark voltage (Vdark), energy level applied by the print head 33 to form the print image on the photoconductor surface 33, and the voltage applied to the applicator 34 or Vbias. At block 100, the machine control 50 initiates an adjustment operation to adjust the electrostatic charges to improve performance. This adjustment operation may be initiated as part of initialization or setup or performed before or after a print job to dynamically adjust the electrostatic charges dynamically during print operations.

The machine control 50 causes the corona 30 to apply (at block 102) a dark voltage ($V_{dark}$) to the photoconductor drum 31 to provide a negative charge to the photoconductor drum. The machine control 50 then controls (at block 104) the print head 33 to expose an image area of the photoconductor drum 31 to which the negative charge is applied to an energy level to discharge the negative charge from the image area. Toner is attracted to this discharged area. The machine control 50 then causes (at block 106) the sensor 37 to measure an exposure voltage of the photoconductor drum 31 after the image area is exposed to the energy level. The machine control 50 performs (at block 108) a first optimization to determine an adjusted dark voltage ($V_{dark}$) and an adjusted energy level based on the measured exposure voltage and the dark voltage and the energy level applied to the photoconductor drum.

In one embodiment, to perform the optimization, the machine control 50 seeks to optimize an equation (1) for the photoconductor exposure voltage ($V_{PC}$):

$$V_{pc} = V_{saturation} + (V_{dark} - V_{saturation})e^{\frac{Energy}{Energy_a}} \quad (1)$$

In this equation, $V_{saturation}$ comprises the voltage at the highest exposure, Energy comprises the energy level to which the print image is exposed to by the print head 33 to 15 discharge the negatively charged region of the print image area of the photoconductor drum 31, and Energy a is a photoconductor energy sensitivity constant. The machine control 50 includes an algorithm to perform a non-linear optimization to select a $V_{dark}$ and energy level (Energy), where $V_{pc}$ is the measured charge on the photoconductor drum 31 and $V_{saturation}$ is a predefined value. The optimization seeks to select values for $V_{dark}$ and 20 the energy level such that the relationship of the measured $V_{PC}$ is linear with respect to the energy level, such that changes to $V_{PC}$ are linear with respect to changes in the energy level. Other non-linear programming optimization techniques may be used to select the values for $V_{dark}$ and the energy level to optimize with respect to the measured photoconductor charge ($V_{PC}$), $V_{dark}$, and $V_{saturation}$.

In an alternative embodiment, the machine control may perform the first optimization by fixing one of the variables, e.g., $V_{dark}$ or the energy level, and adjusting the non-fixed variable until the measured $V_{PC}$ teaches a target value, where multiple iterations of the operations at block 102 through 108 are performed until the measured $V_{PC}$ approximates the target $V_{PC}$.

Figure 3A:
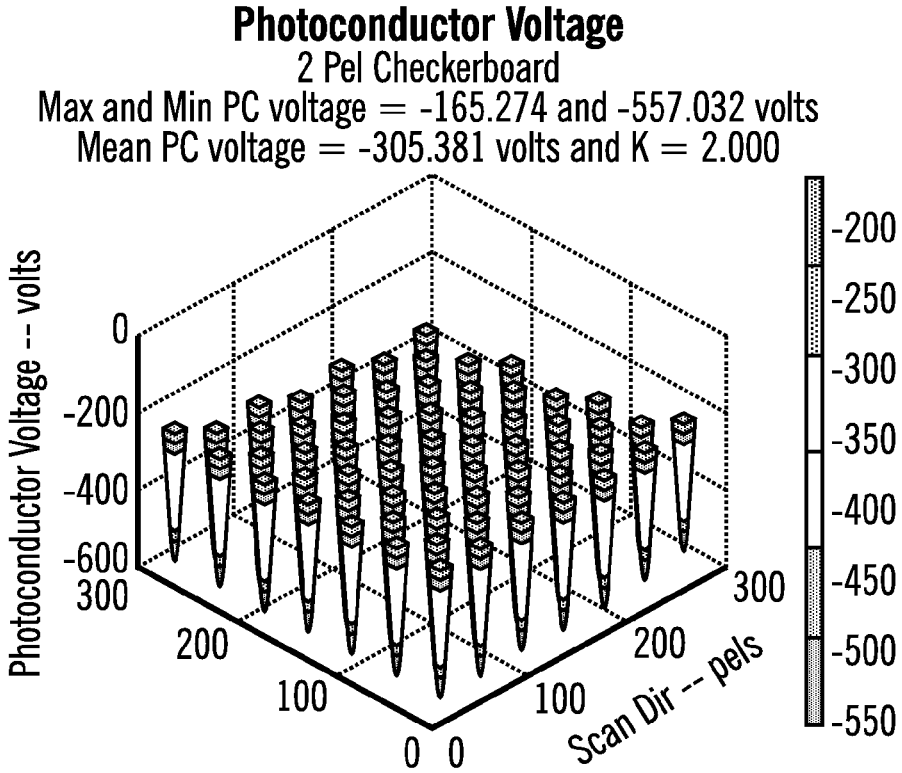
FIGS. 3*a* and 3*b* illustrate a representation of a target electrostatic charge to use during optimization.
Figure 3B:
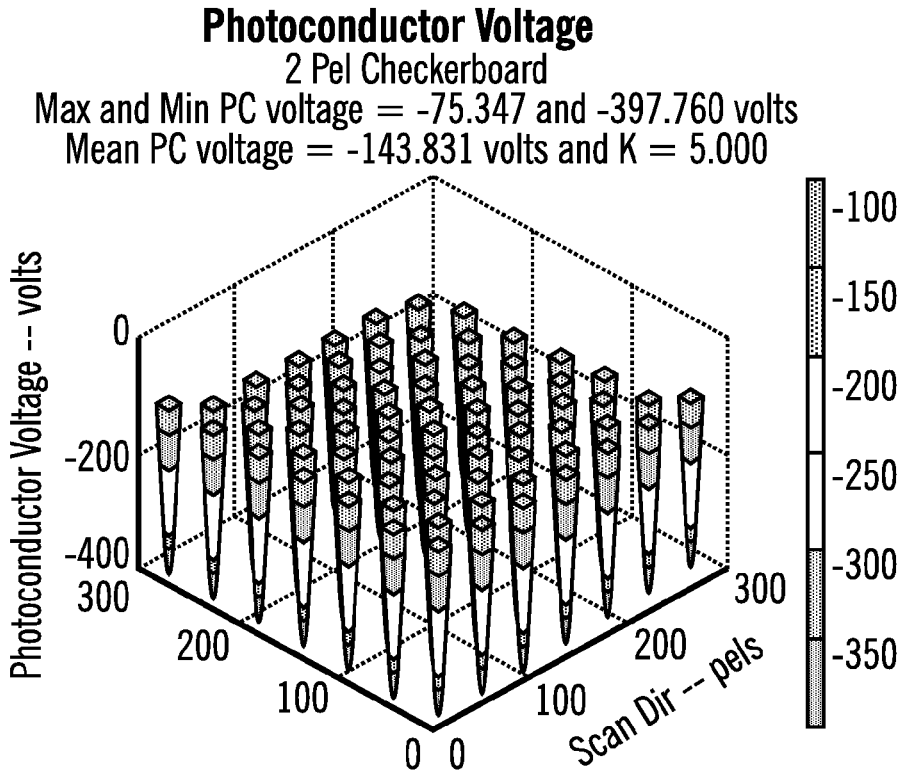

In a yet further alternative embodiment, the measured $V_{PC}$ may comprise a print area. The machine control 50 may maintain in the ROM 56 target voltage distributions, such as shown in FIGS. 3*a* and 3*b*. The machine control 50 may determine the extent to which the measured $V_{PC}$ for the area matches a target voltage distribution, such as shown in FIGS. 3*a* and 3*b*, and adjust the $V_{dark}$ and/or energy level to better approximate the target voltage distribution. In FIGS. 3*a* and 3*b*, the goal may comprise for the individual light emitting diodes (LEDs) in the print head 33 to be uniform, such that the output from all the LEDs has approximately equal voltage output.

Other techniques may be used to perform the first optimization to optimize the $V_{dark}$ and energy level based on the measured charge ($V_{PC}$) of the photoconductor drum 31. In certain embodiments, the objective is to set the electrostatic voltages on the photoconductor to optimize the resulting latent electrostatic image based on the optimal image striking the photoconductor drum 31 from the print head output.

The machine control 50 may then apply an applicator voltage (e.g., $V_{dark}+V_{_solid_area}$) to a toner applicator 34 (mag brush 34). This voltage applied at the applicator comprises the bias voltage 55. The applicator voltage may comprise the previously determined dark voltage ($V_{dark}$) plus a solid area voltage ($V_{_solid_area}$), which comprises an additional voltage, or scalar value, to increase the area of the toner distribution for the pel. Thus, the voltage applied to the applicator 34 (V_mag_brush) may be expressed as equation (2):

$$V_{_mag_brush}=V_{dark}+V_{_solid_area} \quad (2)$$

The toner applicator 34 applies (at block 112) toner charged to the applicator voltage to the exposed image area of the photoconductor drum 31, where the toner is attracted to the discharged print area image of the opposite charge and repelled from the negatively charged background area of the photoconductor drum 31. The toner sensor 36 measures (at block 114) a density of the toner applied to the photoconductor drum 31. The machine control 50 processes this density information to perform (at block 116) a second optimization to adjust the applicator voltage to produce a target toner density by adjusting at least one of the sold area voltage ($V_{_solid_area}$)and dark voltage ($V_{dark}$).

In one embodiment, the machine control 50 performs the second optimization by comparing the measured toner density to a target toner density, and adjusts the applicator voltage to adjust the measured toner density toward the target toner density. For instance, if the measured toner density is below the target toner density, then the applicator voltage ($V_{_mag_brush}$) may be increased, if it is above, the applicator voltage may be decreased. As part of the second optimization, the machine control 50 may adjust at least one of the dark voltage ($V_{dark}$) and the solid area voltage ($V_{_solid_area}$) to affect the applicator voltage to adjust the amount of deposited toner density toward the target toner density.

The machine control 50 may measure the toner density of a pattern and compare to a saved target pattern maintained in the ROM 56. The measured and target patterns may comprise a solid pattern or a checkerboard pattern The adjusted dark voltage resulting from the second optimization is the same dark voltage that is applied to the photoconductor drum before exposing the image area during a subsequent print operation involving applying the dark voltage, exposing the image area, applying the applicator voltage to the applicator to deposit toner, and applying the toner. In this way, adjusting the dark voltage in the second optimization will affect the dark voltage applied to the photoconductor drum 31.

In certain embodiments, the machine control may execute the operations of FIG. 2 multiple times to adjust the dark voltage ($V_{dark}$), applicator voltage ($V_{mag_brush}$), and energy level a number of times until desired results are determined, such as the measured exposure voltage of the photoconductor drum ($V_{PC}$), measured at block 106, and the measured toner density, measured at block 114.

During the operations of FIG. 2, electrostatic charges and toner are deposited on the photoconductor drum 31, but the toner is not applied to paper or other output media. The operations of FIG. 2 may be performed as part of an initial setup and during printer operations before and/or after a print job. Further, the voltage adjustments for the print head 33 at blocks 102-108 and the toner adjustment operations at blocks 110-116 may be performed separately, as well as together.

Additional Embodiment Details

The described operations may be implemented as a method, apparatus or article of manufacture using standard programming and/or engineering techniques to produce software, firmware, hardware, or any combination thereof. The described operations may be implemented as code maintained in a "computer readable storage medium", where a processor may read and execute the code from the computer storage readable medium. A computer readable storage medium may comprise storage media such as magnetic storage medium (e.g., hard disk drives, floppy disks, tape, etc.), optical storage (CD-ROMs, DVDs, optical disks, etc.), volatile and non-volatile memory devices (e.g., EEPROMs, ROMs, PROMs, RAMs, DRAMs, SRAMs, Flash Memory, firmware, programmable logic, etc.), etc. The code implementing the described operations may further be implemented in hardware logic implemented in a hardware device (e.g., an integrated circuit chip, Programmable Gate Array (PGA), Application Specific Integrated Circuit (ASIC), etc.). Still further, the code implementing the described operations may be implemented in "transmission signals", where transmission signals may propagate through space or through a transmission media, such as an optical fiber, copper wire, etc. The transmission signals in which the code or logic is encoded may further comprise a wireless signal, satellite transmission, radio waves, infrared signals, Bluetooth, etc. The "article of manufacture" may comprise a transmitting station and/or a receiving station for transmitting and receiving transmission signals in which the code or logic is encoded, where the code or logic encoded in the transmission signal may be decoded and stored in hardware or a computer readable storage medium at the receiving and transmitting stations or devices. An "article of manufacture" comprises a computer readable storage medium, hardware device, and/or transmission transmitters or receivers in which code or logic may be implemented. Those skilled in the art will recognize that many modifications may be made to this configuration without departing from the scope of the present invention, and that the article of manufacture may comprise suitable information bearing medium known in the art.

The described operations maybe performed with respect to a color printer or black and white printer. For a color printer, optimization may be performed for the different color print heads and toner.

The terms "an embodiment", "embodiment", "embodiments", "the embodiment", "the embodiments", "one or more embodiments", "some embodiments", and "one embodiment" mean "one or more (but not all) embodiments of the present invention(s)" unless expressly specified otherwise.

The terms "including", "comprising", "having" and variations thereof mean "including but not limited to", unless expressly specified otherwise.

The enumerated listing of items does not imply that any or all of the items are mutually exclusive, unless expressly specified otherwise.

The terms "a", "an" and "the" mean "one or more", unless expressly specified otherwise.

The use of variable references, such as "n" or "m", etc., to denote a number of instances of an item may refer to any integer number of instances of the item, where different variables may comprise the same number or different numbers. Further, a same variable reference used with different elements may denote a same or different number of instances of those elements.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

Further, although process steps, method steps, algorithms or the like may be described in a sequential order, such processes, methods and algorithms may be configured to work in alternate orders. In other words, any sequence or order of steps that may be described does not necessarily indicate a requirement that the steps be performed in that order. The steps of processes described herein may be performed in any order practical. Further, some steps may be performed simultaneously.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article or a different number of devices/articles may be used instead of the shown number of devices or programs. The functionality and/or the features of a device may be alternatively embodied by one or more other devices which are not explicitly described as having such functionality/features. Thus, other embodiments of the present invention need not include the device itself.

FIG. 4 provides a table of other combinations of charges that may be used for the photoconductor voltage and the toner charge, and the resulting type of laser printer operations. For instance, if the photoconductor voltage and toner charge have the same polarity, i.e., positive or negative, the laser printer operations are described as employing discharged area development (DAD). If the photoconductor voltage and toner charge have opposite polarity, then the laser printer operations are described as charged area development (CAD).

The illustrated operations of FIG. 2 show certain events occurring in a certain order. In alternative embodiments, certain operations may be performed in a different order, modified or removed. Moreover, steps may be added to the above described logic and still conform to the described embodiments. Further, operations described herein may occur sequentially or certain operations may be processed in parallel. Yet further, operations may be performed by a single processing unit or by distributed processing units. Still further, different polarities may be used for the photoconductor voltage and toner charge as shown in FIG. 4.

The foregoing description of various embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method, comprising:

applying a charge on a surface of a photoconductor drum to create a defined dark voltage;

exposing an image area of the photoconductor drum with a printhead using a defined energy level to discharge the charge from the image area to create an exposure voltage;

measuring the exposure voltage of the photoconductor drum after the image area has been exposed by the printhead;

performing a first optimization to determine an adjusted dark voltage and an adjusted energy level based on the measured exposure voltage and the defined dark voltage and the defined energy level applied to the photoconductor drum, wherein performing the first optimization comprises performing a non-linear analysis to select the adjusted energy level and the adjusted dark voltage such that the measured exposure voltage of the photoconductor drum is approximately linear with respect to the adjusted energy level;

applying an applicator voltage to an applicator that applies toner to the exposed image area of the photoconductor drum;

measuring toner density of the toner applied to the photoconductor drum; and performing a second optimization to adjust the applicator voltage to produce a target toner density.

2. The method of claim 1, wherein the exposure voltage of the photoconductor is modeled as a function of the adjusted dark voltage, a saturation voltage, and the adjusted energy level.

3. The method of claim 1, wherein performing the first optimization comprises comparing the measured exposure voltage of the image area to a target voltage of the image area and adjusting the defined dark voltage and the defined energy level to adjust the measured exposure voltage to closer approximate the target voltage of the image area.

4. The method of claim 3, wherein the target voltage of the image area provides for uniform voltage over the image area.

5. The method of claim 1, wherein the second optimization compares the measured toner density to the target toner density, and adjusts the applicator voltage to adjust the measured toner density toward the target toner density.

6. The method of claim 1, wherein the applicator voltage is a function of the adjusted dark voltage and a solid area voltage, and wherein the second optimization adjusts at least one of the adjusted dark voltage and the solid area voltage to effect the applicator voltage to adjust the measured toner density toward the target toner density.

7. The method of claim 6, wherein the applicator voltage is a function of the adjusted dark voltage.

8. The method of claim 6, wherein the adjusted dark voltage resulting from the second optimization is the voltage applied to the photoconductor drum before exposing the image area during a subsequent print operation involving applying the defined dark voltage, exposing the image area, applying the applicator voltage to the applicator to deposit toner, and applying the toner.

9. The method of claim 1, wherein the operations of the first and second optimizations are performed as part of an initial setup of a printer including the photoconductor drum before or after a print job at the printer.

10. The method of claim 1, wherein the charge applied to the photoconductor drum comprises a positive or negative charge and wherein a charge applied to the toner comprises a positive or negative charge.

11. A system, comprising:

a photoconductor drum;

a corona;

a printhead;

a sensing probe;

an applicator having an applicator voltage, wherein the applicator applies toner to an exposed image area of the photoconductor drum;

a toner sensing probe; and a machine control to cause operations, the operations comprising:

causing the corona to apply a charge on the a surface of the photoconductor drum to create a defined dark voltage;

causing the printhead to expose an image area of the photoconductor drum using a defined energy level to discharge the charge from the image area to create an exposure voltage;

measuring, with the sensing probe, the exposure voltage of the photoconductor drum after the image area has been exposed by the printhead;

performing a first optimization to determine an adjusted dark voltage and an adjusted energy level based on the measured exposure voltage and the defined dark voltage and the defined energy level applied to the photoconductor drum, wherein performing the first optimization comprises performing a non-linear analysis to select the adjusted energy level and the adjusted dark voltage such that the measured exposure voltage of the photoconductor drum is approximately linear with respect to the adjusted energy level;

receiving, from the toner sensing probe, a toner density of the toner applied to the photoconductor drum; and performing a second optimization to adjust the applicator voltage to produce a target toner density.

12. The system of claim 11, wherein the exposure voltage of the photoconductor is modeled as a function of the adjusted dark voltage, a saturation voltage, and the adjusted energy level.

13. The system of claim 11, wherein performing the first optimization comprises comparing the measured exposure voltage of the image area to a target voltage of the image area and adjusting the defined dark voltage and the defined energy level to adjust the measured exposure voltage to closer approximate the target voltage of the image area.

14. The system of claim 11, wherein the applicator voltage is a function of the adjusted dark voltage and a solid area voltage, and wherein the second optimization adjusts at least one of the adjusted dark voltage and the solid area voltage to effect the applicator voltage to adjust the measured toner density toward the target toner density.

15. An article of manufacture implemented in a printing system to cause operations with respect to a photoconductor drum, a printhead, and an applicator in the printing system, the operations comprising:

applying a charge to a surface of the photoconductor drum to create a defined dark voltage;

exposing an image area of the photoconductor drum with the printhead using a defined energy level to discharge the charge from the image area to create an exposure voltage;

measuring the exposure voltage of the photoconductor drum after the image area has been exposed by the printhead;

performing a first optimization to determine an adjusted dark voltage and an adjusted energy level based on the measured exposure voltage and the defined dark voltage and the energy levels applied to the photoconductor drum, wherein performing the first optimization comprises performing a non-linear analysis to select the adjusted energy level and the adjusted dark voltage such that the measured exposure voltage of the photoconductor drum is approximately linear with respect to the adjusted energy level;

applying an applicator voltage to the applicator that applies toner to the exposed image area of the photoconductor drum;

measuring toner density of the toner applied to the photoconductor drum; and performing a second optimization to adjust the applicator voltage to produce a target toner density.

16. The article of manufacture of claim 15, wherein performing the first optimization comprises comparing the measured exposure voltage of the image area to a target voltage of the image area and adjusting the defined dark voltage and the defined energy level to adjust the measured exposure voltage to closer approximate the target voltage of the image area.

17. The article of manufacture of claim 15, wherein the applicator voltage is a function of the adjusted dark voltage and a solid area voltage, and wherein the second optimization adjusts at least one of the adjusted dark voltage and the solid area voltage to effect the applicator voltage to adjust the measured toner density toward the target toner density.

* * * * *